United States Patent [19]

Unotoro et al.

[11] 4,138,626

[45] Feb. 6, 1979

[54] GAS DISCHARGE DISPLAY APPARATUS

[75] Inventors: Tomoyuki Unotoro, Tokyo; Yoichi Ueda, Takarazuka; Yasunari Shirouchi, Akashi; Hideo Yamashita, Akashi; Sei Sato, Kobe; Kenji Murase, Kakogawa, all of Japan

[73] Assignee: Fujitsu Limited, Kawasaki, Japan

[21] Appl. No.: 690,021

[22] Filed: May 26, 1976

[30] Foreign Application Priority Data

May 28, 1975 [JP] Japan ..... 50-64647
May 28, 1975 [JP] Japan ..... 50-64648

[51] Int. Cl.[2] ..... H05B 41/14; H05B 41/44;

[52] U.S. Cl. ..... 315/169.4; 315/84.6; 58/50 R; 340/700

[58] Field of Search ..... 58/50 R; 340/324 R 315/169 R; 169 TV, 84.6

[56] References Cited

U.S. PATENT DOCUMENTS

| | | | |
|---|---|---|---|
| 3,255,378 | 6/1966 | Kaufman | 315/84.6 |
| 3,456,152 | 7/1969 | Anderson | 315/84.6 |
| 3,878,430 | 4/1975 | Hirose | 315/84.6 |
| 3,908,355 | 9/1975 | Wiesner | 58/50 R |
| 3,944,875 | 3/1976 | Owaki et al. | 315/169 TV |
| 3,976,993 | 8/1976 | Hirose et al. | 315/169 TV |
| 4,051,408 | 9/1977 | Albertine, Jr. et al. | 315/169 R |

*Primary Examiner*—Maynard R. Wilbur
*Assistant Examiner*—Lawrence Goodwin
*Attorney, Agent, or Firm*—Daniel Jay Tick

[57] ABSTRACT

A first glass substrate supports a plurality of electrodes arranged in concentric circles. A second glass substrate supports a plurality of shift electrodes arranged radially. The substrates are positioned face to face with a specified space between them filled with an ionizable gas. The radially arranged shift electrodes are periodically connected to common buses each connected to a corresponding one of a plurality of shift driver circuits equal in number to the buses. At least one of the shift electrodes is selectively connected to a write driver circuit and to one of the shift driver circuits. When the one of the shift electrodes is energized by a signal from the write driver circuit, discharge spots are generated at the intersection of the one of the shift electrodes and the concentrically arranged electrodes. The discharge spots are endlessly shifted in clockwise or counterclockwise direction along the concentrically arranged electrodes through the switching of operating voltages applied sequentially to the shift electrodes from the shift driver circuits via the buses.

3 Claims, 21 Drawing Figures

WRITE VOLTAGE PULSE TRAIN

OPERATING VOLTAGE PULSE TRAIN

OPERATING VOLTAGE PULSE TRAIN

OPERATING VOLTAGE PULSE TRAIN

OPERATING VOLTAGE PULSE TRAIN

WRITE DRIVER CIRCUIT AND SHIFT DRIVER CIRCUIT

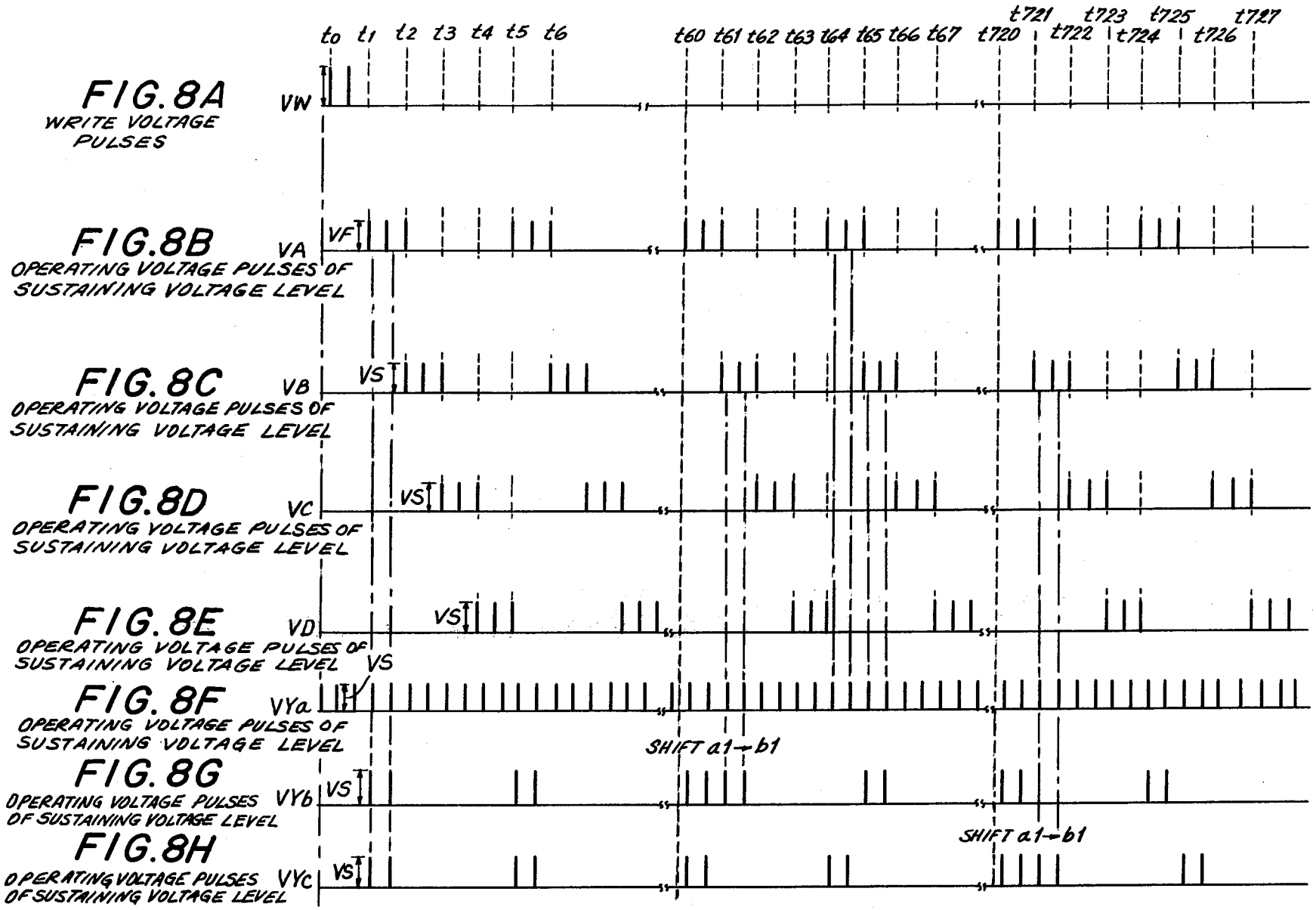

FIG. 8A WRITE VOLTAGE PULSES

FIG. 8B OPERATING VOLTAGE PULSES OF SUSTAINING VOLTAGE LEVEL

FIG. 8C OPERATING VOLTAGE PULSES OF SUSTAINING VOLTAGE LEVEL

FIG. 8D OPERATING VOLTAGE PULSES OF SUSTAINING VOLTAGE LEVEL

FIG. 8E OPERATING VOLTAGE PULSES OF SUSTAINING VOLTAGE LEVEL

FIG. 8F OPERATING VOLTAGE PULSES OF SUSTAINING VOLTAGE LEVEL

FIG. 8G OPERATING VOLTAGE PULSES OF SUSTAINING VOLTAGE LEVEL

FIG. 8H OPERATING VOLTAGE PULSES OF SUSTAINING VOLTAGE LEVEL

GAS DISCHARGE DISPLAY APPARATUS

BACKGROUND OF THE INVENTION

The present invention relates to gas discharge display apparatus. More particularly, the invention relates to an AC plasma display panel providing a looped rotary display due to shift operation of discharge spots.

Mechanical displays or electronic displays have been used as indicators of various measuring instruments and as time displays of clocks. However, mechanical indicators of the type utilizing a pointer are very complicated in configuration and occupy large spaces. Furthermore, electronic displays functioning as indicators capable of displaying values analogously or digitally have very complicated driver circuits.

On the other hand, an AC driven plasma display panel having a discharge spot shifting function is well known as gas discharge display apparatus. This type of plasma display panel is described in pending U.S. Pat. Application Ser. No. 277,564, now U.S. Pat. No. 3,944,875, filed by Urade et al and entitled "Gas Discharge Device Having a Function of Shifting Discharge Spots". The plasma display panel described in the application is so constructed that the discharge spot generated at one end of the panel based on the write signal is self-shifted toward the other end of the panel by sequential switching of a multiphase operating voltage for the shift electrodes. The self-shifting plasma display has the excellent advantage that the configuration of the driver circuit may be distinctively simplified as compared with that of the conventional plasma display of matrix type. The currently known self-shifting plasma display device is deficient, however, since it cannot provide a looped rotary display like various kinds of meters and clocks.

The principal object of the invention is to provide gas discharge display apparatus which is capable of providing a looped rotary display.

An object of the invention is to provide gas discharge display apparatus of simple circuit structure which can rotate the discharge spot.

Another object of the invention is to provide electronic analog gas discharge display apparatus which can be used in the same manner as the meter indicator of various measuring instruments and the hands of a clock.

Still another object of the invention is to provide gas discharge display apparatus which can rotate the discharge spots for display at respectively different speeds in a plurality of channels arranged as concentric circles.

Yet another object of the invention is to provide an improved self-shifting plasma display which can shift the discharge spot in accordance with an input signal up to a predetermined position along the closed loop of a predetermined shift channel.

BRIEF SUMMARY OF THE INVENTION

The gas discharge display apparatus comprises a first substrate supporting at least one of a plurality of looped electrodes arranged thereon in order to form a shift channel. A second substrate supports a plurality of shift electrodes arranged thereon radially in substantially equiangular relation. The first and second substrates are positioned face to face with a gap provided therebetween. The gap is filled with ionizable gas. The shift electrodes are connected periodically to a plurality of buses and the operating voltage is sequentially applied from a plurality of shift driver circuits. At least one of the shift electrodes is connected to one of the shift driver circuits and is selectively connected to a write driver circuit provided separately for providing write voltage. Thus, when a firing voltage is applied for writing across the looped electrodes and the one of the shift electrodes under the condition that the one of the shift electrodes is connected to the write driver circuit, the discharge spot is generated at the intersection of such electrodes. The discharge spots are shifted along the looped electrodes through the switching of the operating voltages supplied sequentially to the shift electrodes from the shift driver circuits via the buses. If the one of the shift electrodes is switched to any of the shift driver circuits upon completion of the writing operation, the discharge spots may be rotated along the looped electrode.

In accordance with the invention, the gas discharge display apparatus comprises a gas discharge panel having a pair of substrates positioned face to face with a gap therebetween. The gap is filled with an ionizable gas. A plurality of shift electrodes are regularly arranged to extend radially on at least one of the substrates at the gap. A dielectric layer coats the shift electrodes. Channel means provides a plurality of endless shift channels in the gap extending in a direction intersecting the shift electrodes. A write driver circuit applies a write voltage to at least one of the shift electrodes for generating a discharge spot in each shift channel at a predetermined time. A plurality of shift driver circuits are individually controlled in sequence for applying an operating voltage to each of the shift electrodes for shifting the discharge spot on a given shift electrode to an adjacent shift electrode at a time in each shift channel. Circuit means has electrical conductors including a plurality of buses sequentially connecting the shift electrodes in a predetermined order to the common terminals via the buses. The circuit means connects at least one of the shift electrodes to the write driver circuit at a predetermined time in the operation of the apparatus wherein an indication line consisting of a plurality of the discharge spots generated at a time on the given shift electrode is shifted to rotate.

A control circuit provides an addition control pulse and a subtraction control pulse in response to a deviation between an information to be displayed and a position of the indication line. A reversible counter has a plurality of stages each coupled to a corresponding one of the shift driver circuits whereby the output of each stage of the reversible counter drives the corresponding shift driver circuit. The reversible counter counts an addition control pulse and a subtraction control pulse from the control circuit for controlling the shift operation of the indication line.

Each of a plurality of gas discharge panels is connected to a corresponding one of a plurality of sets of the shift driver circuits. Timing control circuit means are provided. Each of the timing control circuit means is connected to the corresponding one of the plurality of sets of the shift driver circuits for controlling the shift timing of the respective indication lines on the gas discharge panels in response to input signals.

The channel means comprises at least one looped electrode on the other of the substrates, and preferably comprises a plurality of looped electrodes concentrically arranged on the other of the substrates.

In another embodiment of the invention, the gas discharge display apparatus comprises a gas discharge panel having a first substrate. A plurality of looped electrodes are concentrically arranged on the first substrate. The looped electrodes are in a plurality of groups. A first dielectric layer coats the looped electrodes at a surface of the first substrate. A second substrate is provided. A plurality of radially extending shift electrodes are arranged regularly on the second substrate. A second dielectric layer coats the shift electrodes at a surface of the second substrate. The substrates are positioned face to face with a gap therebetween. The gap is filled with an ionizable gas. A plurality of common terminals are provided. Each of the common terminals is connected to a corresponding one of the groups of looped electrodes. A plurality of common drive circuits provide operating voltages. Each of the common drive circuits is connected to a corresponding one of the common terminals and each is individually controlled for applying a corresponding timing drive. A plurality of buses are provided. Each of the buses connects the shift electrodes sequentially. A write driver circuit applies a write voltage and is connected to at least one of the shift electrodes for generating a plurality of discharge spots on the one of the shift electrodes at a starting time. A plurality of shift driver circuits provide shift voltages sequentially for shift operation. The shift driver circuits are connected respectively to the buses for shifting the discharge spots from a given shift electrode to an adjacent shift electrode along each of the groups of the looped electrodes. Thus, a plurality of indication lines each displayed in the respective groups of the looped electrodes are shifted to rotate at a selected rate.

Selection switching means is connected to the write driver circuit for controlling the operation of the write driver circuit. A pulse generating circuit provides a standard pulse train. A control circuit includes first counter means for switching the timing of application of the shift voltage to the buses from the shift driver circuits. Second counter means controls the timing of application of the operating voltages to at least one of the common terminals from at least one of the common drive circuits at predetermined counts of the second counter means. The first counter means counts the standard pulses from the pulse generating circuit. The second counter means counts the standard pulses in divided relation.

BRIEF DESCRIPTION OF THE DRAWINGS:

In order that the invention may be readily carried into effect, it will now be described with reference to the accompanying drawings, wherein:

FIGS. 8A to 8H are waveforms of operating voltages utilized to drive the gas discharge display apparatus of FIG. 6;

In the figures, the same components are identified by the same reference numerals.

DETAILED DESCRIPTION OF THE INVENTION

Figure 1:
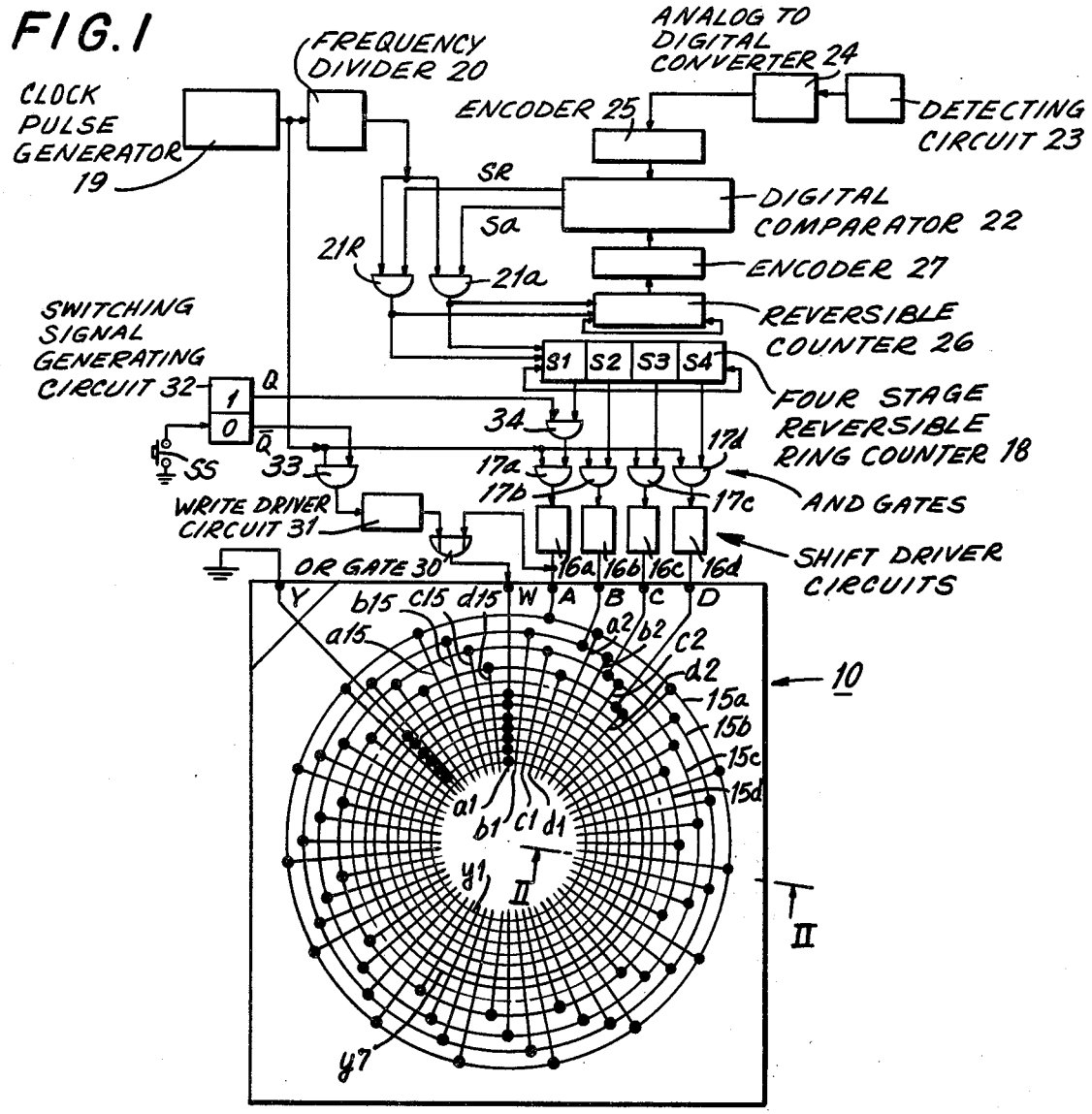
FIG. 1 is a plan view of an embodiment of the gas discharge display apparatus of the invention and a block diagram of an embodiment of the driving system thereof.
Figure 2:
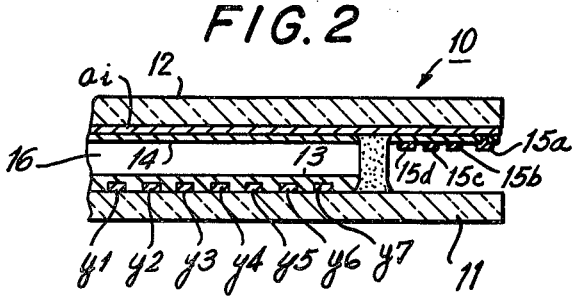
FIG. 2 is a cross-sectional view, taken along the lines II—II, of FIG. 1.

As shown in FIGS. 1 and 2, a gas discharge panel or plasma display panel 10 is a hermetically sealed unit comprising two sheets of glass or two glass substrates 11 and 12. A plurality of looped electrodes y1 to y7 are arranged concentrically within the first glass substrate 11 located at the rear of the unit. The electrodes y1 to y7 are coated with a dielectric layer 13 consisting, for example, of glass material having a low melting point. A plurality of shift electrodes ai, bi, ci, di, where i is an integer, are arranged radially within the second glass substrate 12 located at the front of the unit. The shift electrodes ai, bi, ci, di are positioned face to face with the looped electrodes y1 to y7. The shift electrodes are coated with a dielectric layer 14 similar to the layer 13.

The looped electrodes y1 to y7 are connected with each other in common on the substrate 11 and are led out to a common terminal Y. The shift electrodes ai to di are classified in a total of four groups of every other three electrodes. The shift electrodes of the first group, indicated by the sign ai, are connected in common to a bus 15*a*, except for only one shift electrode a1 in the substrate 12, and are then led to a terminal A. The shift electrodes of the second group, indicated by the sign bi, are connected in common to a bus 15*b*, and are then led to a terminal B. The shift electrodes of the third group, indicated by the sign ci, are connected in common to a bus 15*c*, and are then led to a terminal C. The shift electrodes of the fourth group, indicated by the sign di, are connected in common to a bus 15*d*, and are then led to a terminal D. 0nly one shift electrode a1, of the first group, is individually led to a terminal W.

As hereinbefore described, the two substrates 11 and 12, respectively supporting electrodes, are positioned face to face with a predetermined gap 16 between the substrates. The substrates are hermetically sealed, forming an envelope. Furthermore, the gap 16 is filled with an ionizable gas to provide a gas discharge panel, as shown in FIGS. 1 and 2. In this case, there is no particular limitation required for the panel configuration, except for special patterns of the electrode arrangement.

In accordance with the invention, in order to attain rotary display operation, such as meter indications, for example, by using the aforedescribed gas discharge panel, a plurality of shift driver circuits 16*a*, 16*b*, 16*c* and 16*d* for applying the operating voltage are connected to the four shift electrode terminals A, B, C and D, respectively. In addition, in order to sequentially drive the shift driver circuits 16*a* to 16*d* with the timing of clock pulses, in accordance with a shift command signal, the inputs of said shift driver circuits are connected to outputs S1, S2, S3, S4 of a four stage reversible ring counter 18 via a plurality of AND gates 17*a*, 17*b*, 17*c* and 17*d*.

A divided pulse from a frequency divider 20 connected to a clock pulse generator 19 is supplied as input to the two inputs of the reversible counter 18 via two AND gates 21*a* and 21R. The AND gates 21*a* and 21R are controlled by an addition control signal Sa and a subtraction control signal SR, respectively. A digital comparator 22 derives the addition control signal Sa and the subtraction control signal SR. That is, the digital comparator 22 compares a first BCD signal SP and a second BCD signal SC. The first BCD signal SP is obtained, from an encoder 25 as the signal corresponding to the position to be displayed on the panel 10, by coding the digital signal derived from an analog to digital converter 24. The converter 24 converts the analog signal detected by a detecting circuit 23.

The second BCD signal SC, compared with first BCD signal SP, is obtained from an encoder 27 by coding the output of a reversible counter 26. The reversible counter 26 functions to show the shifting position of the discharge spot based on the result of counting the addition pulse or the subtraction pulse for the four stage reversible ring counter 18. The digital comparator 22 supplies the addition control signal Sa or the subtraction control signal SR to the AND gates 21*a* and 21R in accordance with the difference of the aforedescribed comparison.

On the other hand, in order to generate the initial discharge on the shift electrode a1 line, the terminal W of the relevant shift electrode is connected to a write driver circuit 31 via an OR gate 30. A clock pulse for driving the write driver circuit 31 is supplied to said write driver circuit via a first switching AND gate 33 which is controlled by one output Q of a switching signal generating circuit 32. The switching signal generating circuit 32 preferably comprises a flip flop circuit. The other output Q of the switching signal generating circuit 32 is supplied to the control input terminal of a second switching AND gate 34. The first output S1 of the four stage reversible ring counter 18 is connected to the other input of the AND gate 34. The output of the AND gate 34 is connected to an input of the AND gate 17*a*. The output Q of switching signal generating circuit 32 may also be used as the reset signal for both the four stage reversible counter 18 and the reversible counter 26.

Figure 3A:
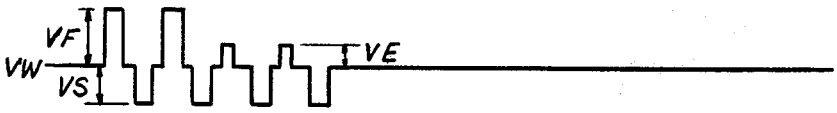
FIGS. 3A to 3E are waveforms of operating voltages utilized to drive the gas discharge display apparatus of FIG. 1.

In operation, it is assumed that the common terminal Y is connected to a point at ground potential and that the reversible ring counter 18 is in the reset condition of 1, 0, 0, 0. In this condition, when a start switch SS, connected to the switching signal generating circuit 32, is first closed, the switching signal generating circuit 32 changes in condition from its condition 1, 0 to its condition 0, 1 during this period and the first switching AND gate 33 is opened or switched to its conductive condition by the Q output of said switching signal generating circuit being "1". As a result, the write driver circuit 31 is driven in synchronization with the clock pulse passing through the AND gate 33. Thus, the write voltage pulse train VW, shown in FIG. 3A, is applied to the intersection of the looped electrodes y1 to y7 and the shift electrode a1. The write voltage pulse train VW includes a positive pulse having a voltage level VF exceeding the firing voltage at the intersection and a negative pulse having a voltage level VS of the discharge sustaining voltage lower than the firing voltage and initiates the discharge spot at the relevant intersection.

Figure 3B:
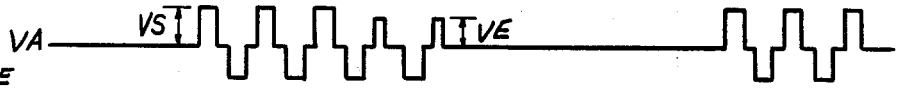
Figure 3C:
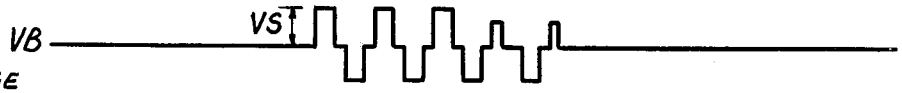
Figure 3D:
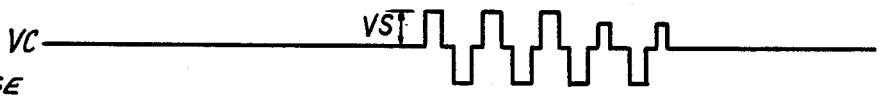
Figure 3E:
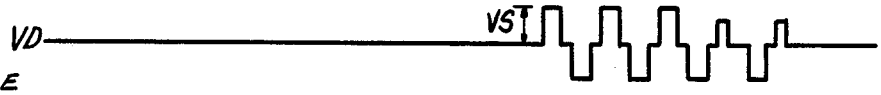

Thereafter, when the start switch SS is opened, the switching signal generating circuit 32 returns to its state 1, 0. Thereby, the second switching AND gate 34 is opened or switched to its conductive condition by the Q output of the switching signal generating circuit 32 being "1", and the AND gate 17*a* is opened or switched to its conductive condition when the first output stage S1 of the reversible ring counter 18 is "1" in the preset condition 1, 0, 0, 0 of said counter. The first shift driver circuit 16*a* is thus driven by the clock pulse passing through the AND gate 17*a*, and the operating voltage pulse train VA, shown in FIG. 3B, is applied to the intersection of the looped electrodes y1 to y7 and the first shift electrode a1 via the OR gate circuit 30. The operating voltage pulse train VA supplied by the shift driver circuit 16*a* includes positive and negative pulses having the sustaining voltage level VS and contributes to maintain the discharge spot generated by the write voltage pulse train VW with the help of the wall charge accumulated on the surfaces of the dielectric layers 13 and 14 (FIG. 2).

When the detecting circuit 23 generates a signal having a specified level, under the foregoing condition, such signal is converted to a digital signal by the analog to digital converter 24 and then supplied to the digital comparator 22 after being encoded by the encoder 25. In such case, since the coded signal of the encoder 25 has a higher value than the coded signal output of the encoder 27, indicating the state of the reversible counter 26, the comparator 22 provides the addition control signal Sa as an output. Therefore, the addition AND gate 21*a* is opened or switched to its conductive condition by the addition control signal Sa and the divided frequency output pulse from the clock pulse generator 19 which is divided by the frequency divider circuit 20 is supplied to the four stage reversible ring counter 18 and the reversible counter 26.

The four stage reversible ring counter 18 counts the divided frequency pulse sequentially and opens or switches the AND gates 17*a* to 17*d* to their conductive condition according to the output of each stage, whereby the shift driver circuits 16*a* to 16*d* are sequentially driven. As a result, the operating voltage pulse trains VA to VD of the sustaining voltage level VS are sequentially applied to the shift electrodes of each group connected to the buses A to D in the relations shown in FIGS. 3B to 3E, and the discharge spot on the shift electrode a1 is shifted to the shift electrode b1 at the timing at which the voltage VA for the bus A is switched to the voltage VB for the bus B. Furthermore, the discharge spot is shifted to the shift electrode c1 at the timing at which the operating voltage VB for the bus B is switched to the operating voltage VC for the bus C. The principle of such shift operation of the discharge spot is described in detail in the aforedescribed United States patent.

Thus, the discharge spot on the shift electrode line is shifted in the clockwise direction along the looped electrodes y1 to y7 until the output of digital comparator 22 becomes zero; that is, the point at which the counting output of the reversible counter 26 reaches the signal level specified. The shifting operation stops, in accordance with the state of the reversible ring counter 18, when the output of the comparator 22 becomes zero. When the level of the signal from the detecting circuit 23 is lowered, the subtraction command signal SR is generated by the comparator 22 and the reversible ring counter 18 performs a counting operation in the reverse direction. As a result, the discharge spot shifts in the counterclockwise direction.

The input signal level may thus be displayed as the rotating shift position of the discharge spot. During the shift operation, the operating voltage pulse trains VA and VD supplied to the buses A to D may include the pulse of the erasure voltage level VE, shown in FIG. 3A, at the final period of the signal input. The erasure voltage pulse VE may function to erase the wall charge remaining on the succeeding shift electrodes after the discharge spot has shifted to the adjacent shift electrode, preventing miss-shift operation and simultaneously contributing to high speed shift operation.

Figure 4:
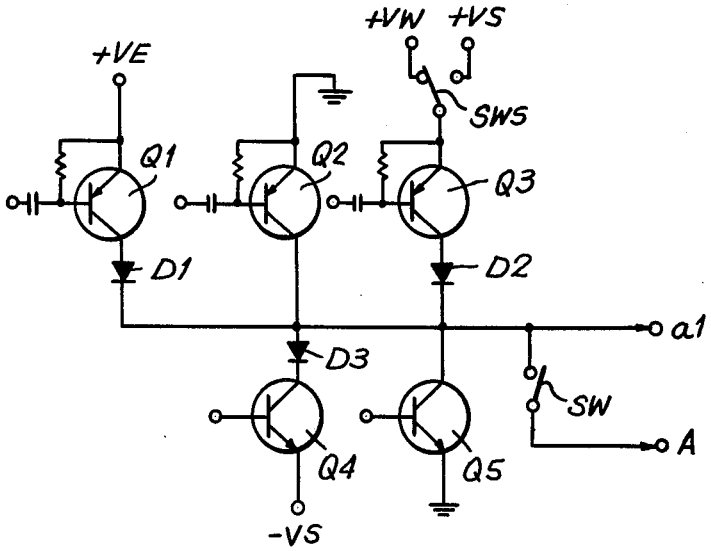
FIG. 4 is a circuit diagram of an embodiment of the write driver circuit and one of the shift driver circuits of the gas discharge apparatus of the invention.

FIG. 4 illustrates an embodiment of the circuit of the write driver circuit 31 and the shift driver circuit 16*a* of FIG. 1. In FIG. 4, switches SWS and SW have a function similar to that of the switching AND gates 33 and 34. A transistor Q3 is commonly used to generate the write voltage pulse VW and the positive sustaining voltage pulse VS in accordance with the switching condition of the switch SWS. When the two switches SWS and SW are in the condition shown in FIG. 4, a positive write voltage pulse produced by alternate driving of the transistors Q3 and Q5, and a negative sustaining voltage pulse produced by alternate driving of the transistors Q2 and Q4 may be supplied to the shift electrode a1, as shown in FIG. 3A. When the two switches SWS and SW are changed over to their reverse condition, opposite that shown in FIG. 4, positive and negative sustaining voltage pulses, as shown in FIG. 3B, may be applied to the bus A by the alternate driving of the pair of transistors Q3 and Q5, and Q2 and Q4. The transistor Q1 is connected to the erasure voltage power supply VE and generates the erase voltage pulse in combination with the transistor Q5.

As shown in FIG. 4, each of the transistors Q1 to Q5 has an emitter electrode, a collector electrode and a base electrode. Each of the transistors Q1 to Q5 is driven via a signal supplied to its base electrode. The erasure voltage is applied to the emitter electrode of the transistor Q1. The switch SWS applies either the write voltage VW or the sustaining voltage VS to the emitter electrode of the transistor Q3. The negative sustaining voltage -VS is applied to the emitter electrode of the transistor Q4. The emitter electrode of the transistor Q2 and the emitter electrode of the transistor Q5 are connected to points at ground potential. The collector electrodes of the transistors Q1 to Q5 are connected to the shift electrode a1, those of the transistors Q1, Q3 and Q4 being connected via diodes D1, D2 and D3, respectively. The switch SW connects the bus A to the shift electrode a1. The transistors Q1, Q2 and Q3 are PNP transistors, whereas the transistors Q4 and Q5 are NPN transistors.

As hereinbefore described, in accordance with the invention, since the discharge spot generated on the shift electrode may be rotated in accordance with the switching of the operating voltages VA to VD applied to the buses A to D of the shift electrode when write operation is performed, the display panel may be utilized as the pointer of a meter indicator. In addition, for example, the display panel may also be used as the hands of a clock. In its utilization with a clock, for example, the aforedescribed gas discharge panel 10 is provided as three layers and the line display in the radial direction of each panel may be used as the pointers of hour, minute and second displays.

Figure 5:
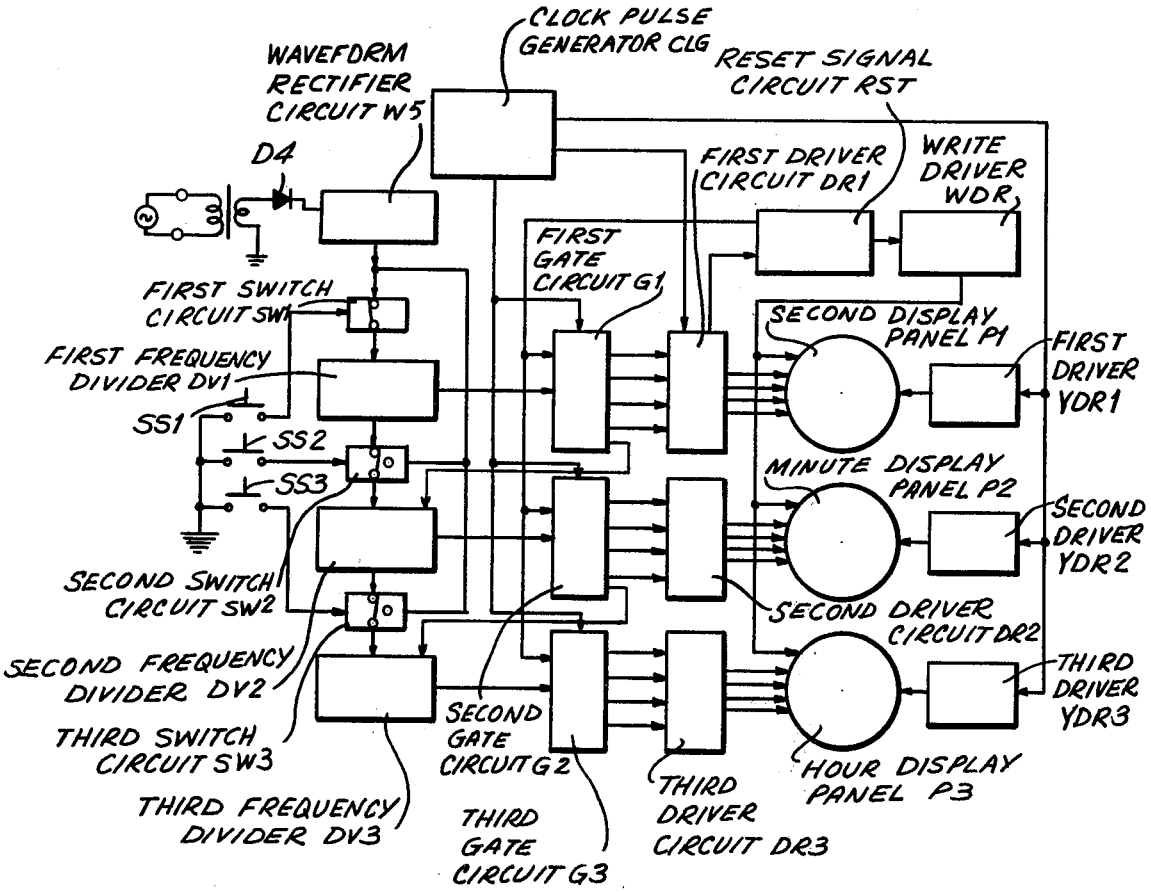
FIG. 5 is a block diagram of an embodiment of time display apparatus utilizing the gas discharge apparatus of the invention.

FIG. 5 is a block diagram of an embodiment of a system which provides the aforedescribed time display in synchronization with the power supply. The alternating current or AC of a commercial power supply is half-wave rectified by a diode D4 and is then applied to the waveform rectifier circuit W5. The waveform rectified output is applied to a first frequency divider circuit DV1 via a first switch circuit SW1. The divided output is then applied to a second frequency divider circuit DV2 through a first gate circuit G1 and a second switch circuit SW2. The divided output of the second frequency divider circuit DV2 is applied to a third frequency divider circuit DV3 via a second gate circuit G2 and a third switch circuit SW3. The output of the third frequency divider circuit DV3 is fed to a third gate circuit G3.

A second display panel P1, a minute display panel P2 and an hour display panel P3 are provided. Each of the panels P1, P2 and P3 comprises a panel of the type shown in FIG. 1. When each panel has four pairs of buses, a total of four pairs of shift voltages are applied by first, second and third driver circuits DR1, DR2, and DR3, respectively, to which the first, second and third gate circuits G1, G2 and G3, respectively, are connected. First, second and third drivers YDR1, YDR2 and YDR3 are connected to the panels P1, P2 and P3, respectively. The drivers YDR1 to YDR3 apply a pulse voltage having a constant period to the terminal Y of FIG. 1. Furthermore, the clock pulse generator CLG supplies a clock pulse to the first, second and third gate circuits G1, G2 and G3, respectively, the first, second and third driver circuits DR1, DR2 and DR3, respectively, and the first, second and third drivers YDR1, YDR2 and YDR3, respectively.

A reset signal circuit RST has an input connected to the first driver circuit DR1 and an output connected in common to the first, second and third gate circuits G1, G2 and G3, respectively, and another output connected to the input of a write driver WDR. The write driver WDR has an output connected in common to the panels P1, P2 and P3. When the reset signal circuit RST generates a reset signal, an erasure pulse is supplied by the driver circuits DR1, DR2 and DR3 to the display panels P1 to P3, erasing the line display used as the pointer. Then, the write driver WDR is driven and a write pulse is supplied to each display panel P1 to P3, resulting in the display of 0 hours, 0 minutes, 0 seconds. Furthermore, the reset signal circuit RST supplies a signal to the gate circuits G1 to G3, and the operation of the driver circuits DR1 to DR3 starts in accordance with the divided output from the frequency dividers DV1 to DV3.

The frequency dividers DV1 to DV3 perform division according to the frequency of the power supply. The line display of the second display panel P1 makes one turn per minute via the first driver circuit DR1, that of the minute display panel P2 makes one turn per hour via the second driver circuit DR2, and that of the hour display panel P3 makes one turn per 24 hours or 12 hours via the third driver circuit DR3. The dividing ratio of the frequency dividers is determined primarily for the aforedescribed display.

A plurality of push-button switches SS1 to SS3 are provided for stop, fast forward minute display and fast forward hour display, respectively, and said switches may therefore be used for time setting, as required. The switches SS1, SS2 and SS3 are connected to the first, second and third switch circuits SW1, SW2 and SW3, respectively.

If it is possible to shift the line display in reverse, by the provision of additional push-buttons, a control may be provided for reversing the turning or rotation of the pointers or hands of the clock.

If the sizes of the display panels P1 to P3 are the same, the display length of the line display differs by respectively changing the number of electrodes yi arranged concentrically in FIG. 1. This permits a display of the second hand, minute hand and hour hand. Furthermore, it is possible to provide a so-called panel surface discharge type by arranging the electrodes in insulated relation on one side of the substrates positioned face to face.

Figure 6:
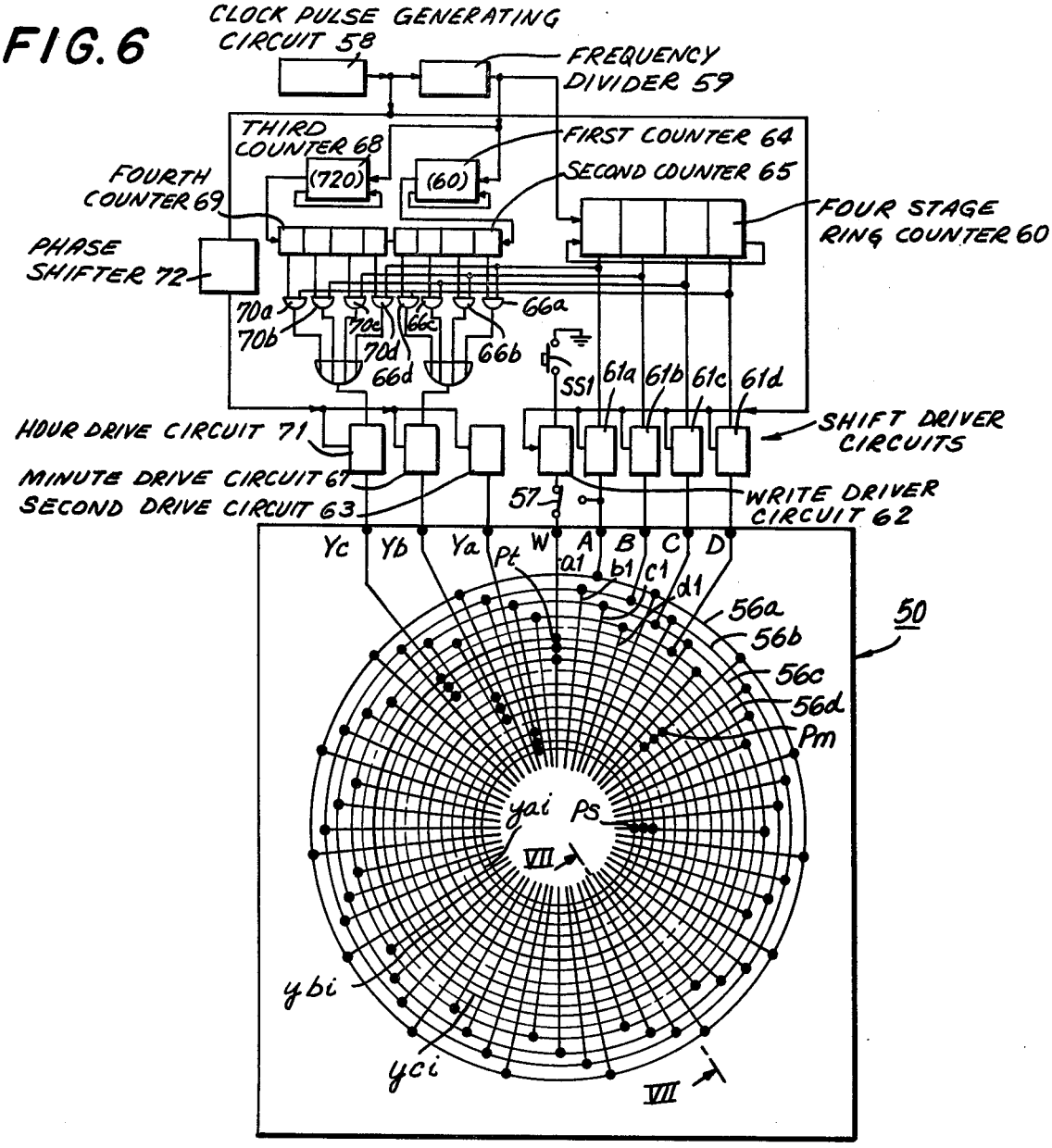
FIG. 6 is a plan view of another embodiment of the gas discharge display apparatus of the invention and a block diagram of another embodiment of the driving system thereof.

It is also possible to provide a system where the discharge spots for displaying seconds, minutes and hours are respectively rotated at different speeds on a single gas discharge panel, as another embodiment of the invention, utilized as a time indicator. FIG. 6 is a block diagram of such a time display apparatus. A gas discharge panel or plasma display panel 50 is provided. As is evident from the sectional view of FIG. 7, the gas discharge panel 50 includes looped electrodes yai, ybi and yci, arranged concentrically on a rear substrate 51 and coated with a dielectric layer 52. The panel 50 also includes shift electrodes ai, bi, ci and di, radially arranged at the inside of a front substrate 53 and coated with a dielectric layer 54.

Figure 7:
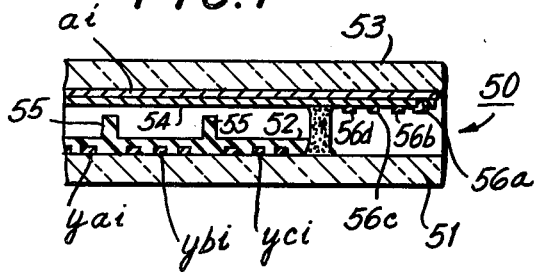
FIG. 7 is a cross-sectional view, taken along the lines VII—VII, of FIG. 6.

The looped electrodes yai, ybi and yci of the panel 50 of FIGS. 6 and 7 are classified in groups of 5 electrodes per unit, so that $i = 1$ to 5, and the groups are connected to the common terminals Ya, Yb and Yc. Furthermore, a barrier 55 is provided between the groups of looped electrodes (FIG. 7) for preventing charge coupling. Thus, for example, a total of 60 shift electrodes ai, bi, ci and di are periodically divided into four groups in units of 15 electrodes, as in FIG. 1, and are respectively connected to terminals A, B, C and D individually via buses 56*a*, 56*b*, 56*c* and 56*d*. On the other hand, as in the embodiment of FIG. 1, one shift electrode al has a selective connecting switch 57 which connects it to the operating voltage supply terminal A and a write voltage supply terminal W.

In order to attain the time display apparatus by using the aforedescribed gas discharge panel 50, shown in FIG. 6, the terminals A, B, C and D are connected to shift drivers 61*a* to 61*d*, respectively, which are driven by a clock pulse from a clock pulse generating circuit 58 and the counting output of a four stage ring counter 60 which counts a pulse having a period of one second, as divided by a frequency divider 59. The write terminal W is connected to a write driver circuit 62 which is controlled by a start switch SS1.

On the other hand, the terminal Ya is connected to the first group yai of the looped electrodes and is connected to a second drive circuit 63, so that the second hand display is provided along the shift channel specified by the relevant electrode group. The terminal Yb is connected to the second looped electrode group ybi and is connected to a minute drive circuit 67, which is controlled via a first counter 64, a second counter 65 and AND gates 66*a* to 66*d*, so that the minute hand display is provided along the shift channel specified by the relevant electrode group. The terminal Yc is connected to the third looped electrode group yci and is connected to the hour drive circuit 71, which is controlled via a third counter 68, a fourth counter 69 and AND gates 70*a* to 70*d*, so that the hour hand display is provided along the shift channel specified by the relevant electrode group. The second, minute and hour drive circuits 63, 67 and 71, respectively, are of such structure that they may be driven by the clock pulse provided by the clock pulse generating circuit 58, the phase of which is shifted by 180° by a phase shifter 72.

In FIG. 6, when the start switch SS1 is closed and the selection switch 57 is connected to the terminal W side, a write voltage pulse VW, shown in FIG. 8A, exceeding the firing voltage, is supplied to the shift electrode ai from the write driver circuit 62. Simultaneously, operating voltage pulses of sustaining voltage level VYa, VYb and VYc, shown in FIGS. 8F, 8G and 8H, are supplied to the respective groups of looped electrodes from the drive circuits 63, 67 and 71. As a result, discharge spots are generated at the intersections of the shift electrode ai and the looped electrodes yai, ybi and yci.

Subsequently, when the selection switch 57 is connected to the terminal A side, operating voltage pulses of sustaining voltage level, shown in FIGS. 8B, 8C, 8D and 8E, are sequentially applied in units of several pulses, which are three pulses in the illustrated example, on the basis of the counting output at every one second of the ring counter 60, at the timing of the clock pulse during such counting period. On the other hand, the aforedescribed operating voltage pulses VYa, VYb and VYc are supplied to each group terminal Ya, Yb and Yc of the looped electrodes. The operating voltage VYa is continuously applied at the timing of the clock pulse shifted by 180°, as is clear from FIG. 8F. Thus, the discharge spots PS on the first group of the looped electrodes ya1 to ya5, to which the operating voltage VYa is applied, are shifted as much as one turn during 60 seconds or one minute.

When the operating voltage VYb is applied from the terminal Yb to the second group of looped electrodes yb1 to yb5, the pulse supply timing is switched, as shown in FIG. 8G, by the second counter 65, which has four stages, and the AND gate 66*a* to 66*d*, each time the first counter 64, which has six stages, counts up to 60 divided pulses with a period of one second. That is, until the discharge spots PS, which indicate seconds, complete one turn, the operating voltage pulse VYb is controlled by the output of the AND gate 66*d* and is then applied to the terminal Yb only at the timing of the shift voltage VA for the terminal A. It is not applied while the other shift voltages VB, VC and VD are applied. Therefore, the discharge spots Pm for the minute display are not shifted from the shift electrode al during 60 seconds.

When 60 seconds pass, however, the operating voltage VYb is applied only at the timing of the shift voltage VB being applied to the terminal B, since the second counter 65 proceeds one step and the AND gate 66*b* opens or switches to its conductive condition. Therefore, the discharge spots Pm for the minute display are shifted to the adjacent shift electrode b1 from the shift electrode al when the voltage supply timing is changed. Thus, one shift operation is carried out every 60 seconds at the looped electrodes of the second group, and the discharge spot Pm makes one turn or revolution in 60 minutes.

The operating voltage VYc applied to the looped electrodes yc1 to yc5 of the third group from the terminal Yc is subject to the switching of the pulse supply timing, as shown in FIG. 8H. This is accomplished by the fourth counter 69, which has four stages, and the AND gates 70*a* to 70*d*, each time the third counter 68 counts the divided pulse having the period of one second up to 720 seconds. More particularly, the operating voltage pulse VYc is controlled by the output of the AND gate 70*a* and is then applied to the terminal Yc only at a timing wherein the shift voltage VA is applied to the terminal A. During this period, the discharge spots Pt for the time display are not shifted.

When 12 minutes, or 720 seconds, have passed, however, the fourth counter 69 counts up one step via the counting output of the third counter 67. The AND gate 70*b* thereby opens, or switches to its conductive condition, and the operating voltage VYc is applied at the timing of the shift voltage VB. Thus, when the voltage supply timing is changed, the discharge spots for the time display are shifted from the shift electrode a1 to the adjacent shift electrode b1, and the shift operation is repeated at an interval of 12 minutes or 720 seconds, causing one turn or revolution in 12 hours. After the write operation is completed at the time of starting, the first shift electrode a1 is connected to the terminal A and is driven in the same manner as the other shift electrodes. Therefore, the analogous rotating time display may be provided continuously.

A fast forward drive circuit may be added to the aforedescribed apparatus for time adjustment. In such case, the first counter 64 and the third counter 68 are presetable counters.

The aforedescribed apparatus provides a time display by rotating the discharge spots of said time display for seconds, minutes and hours on a single panel at individual speeds. The basic principle has various applications, however. In other words, since various data may be rotated easily on a single panel, for example, it is possible to display the difference of several data, which vary in accordance with time as the difference of the speed of rotation of the discharge spots. The discharge spots may be displayed on several meter indicators. In this case, it is natural that the looped electrodes of the gas discharge panel 50 are classified into freely selected groups.

In addition, there is a difference in the gap between the adjacent shift electrodes in the center and the peripheral parts of the gas discharge panel 50. This results in a difference in the coupling of the charge. However, influence of such differences on the operation may be compensated or minimized by tapering the shift electrodes or varying the operating voltages for each electrode group at the looped electrode side.

it is very effective for easy color identification to change the aforedescribed operating voltage by clearly changing the brightness of each display. The same purpose may also be attained by changing the frequency of the operating voltage pulse for the electrodes of each group. Furthermore, the gas discharge panels 10 or 50 may be modified to some extent. An example of the modification of the gas discharge panel is shown in FIGS. 9 and 10.

Figure 9:
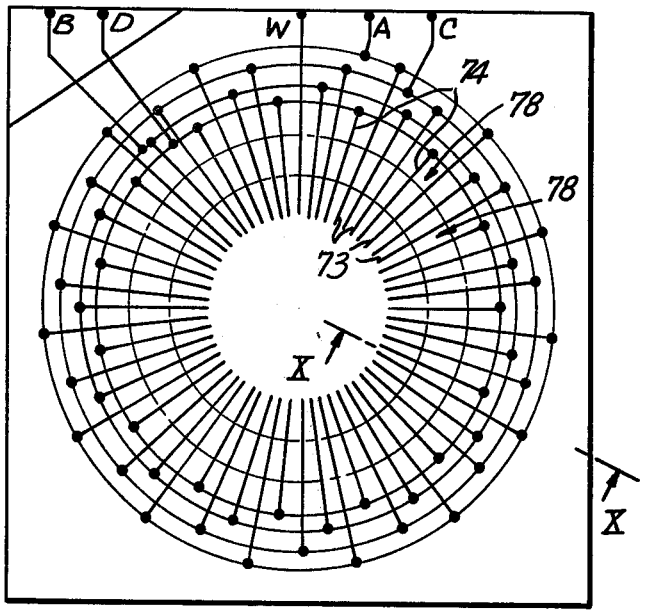
FIG. 9 is a plan view of still another embodiment of the gas discharge display device of the invention.
Figure 10:
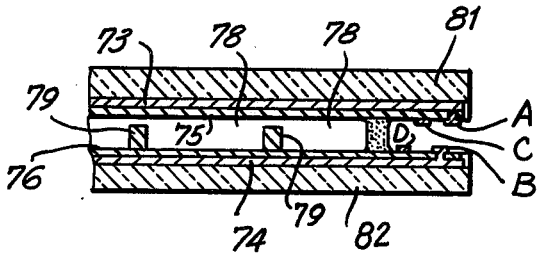
FIG. 10 is a cross-sectional view, taken along the lines X—X, of FIG. 9.

In the embodiment of FIGS. 9 and 10, both substrates 81 and 82 are positioned face to face. The substrates 81 and 82 are provided with radially arranged electrodes 73 and 74, respectively, which are coated with dielectric layers 75 and 76, respectively. The electrodes 73 and 74 are positioned so that they are offset circumferentially. The looped electrodes of the embodiments of FIGS. 1 and 6 are omitted. A barrier 79 (FIG. 10) is provided to give the shift channel 78 a circular form.

Thus, the discharge spots generated between the electrodes positioned obliquely face to face in each shift channel 78 may be rotatably shifted by switching the operating voltage to the commonly connected terminals A to D. In such case, each electrode of FIGS. 9 and 10 may be arranged completely on one substrate, or they may be arranged in such positions that they perfectly correspond to each other on both substrates. Furthermore, the shift channel for discharge spots on the aforedescribed embodiment need not always be circular in shape, but may be formed in any endless shape, such as, for example, rectangular, elliptical or multi-angled shapes.

The apparatus of the invention provides various types of meter indications and time displays by utilizing the technique of self-shifting the discharge spots with full utilization of plasma coupling or charge coupling by means of gas discharge. The apparatus of the invention provides analogous display apparatus of simple circuit configuration using fewer terminals for driving.

While the invention has been described by means of specific examples and in specific embodiments, we do not wish to be limited thereto, for obvious modifications will occur to those skilled in the art without departing from the spirit and scope of the invention.

We claim:

1. Gas discharge display apparatus, comprising a gas discharge panel having a first substrate, a plurality of looped electrodes concentrically arranged on the first substrate, the looped electrodes being in a plurality of groups, a first dielectric layer coating the looped electrodes at a surface of the first substrate, a second substrate, a plurality of radially extending shift electrodes arranged regularly on the second substrate, a second dielectric layer coating the shift electrodes at a surface of the second substrate, said substrate being positioned face to face with a gap therebetween, said gap being filled with an ionizable gas;

a plurality of common terminals each connected to a corresponding one of the groups of looped electrodes;

a plurality of common drive circuits for providing operating voltages, each of said common drive circuits being connected to a corresponding one of the common terminals and each being individually controlled for applying a corresponding timing drive;

a plurality of shift electrode terminals;

a plurality of buses each connecting the shift electrodes sequentially to a corresponding shift electrode terminal;

a write driver circuit for applying a write voltage, said write driver circuit being connected to at least one of the shift electrodes for generating a plurality of discharge spots on said one of said shift electrodes at a starting time;

a plurality of shift drive circuits for providing shift voltages sequentially for shift operation, said shift driver circuits being connected respectively to said buses for shifting the discharge spots from a given shift electrode to an adjacent shift electrode along each of said groups of said looped electrodes wherein a plurality of indication lines each displayed on the respective groups of said looped electrodes are shifted to rotate at a selected rate; and a control circuit including counter means for switching the timing of application of the shift voltage to the buses from the shift driver circuits and for controlling the timing of application of the operating voltages to at least one of the common terminals from at least one of the common drive circuits.

2. Gas discharge display apparatus, comprising a gas discharge panel having a pair of substrates positioned face to face with a gap therebetween, said gap being filled with an ionizable gas, a plurality of shift electrodes regularly arranged to extend radially on at least one of the substrates at the gap, a dielectric layer coating the shift electrodes, and channel means providing a plurality of endless shift channels in said gap extending in a direction intersecting the shift electrodes;

a write driver circuit for applying a write voltage to at least one of the shift electrodes for generating a discharge spot in each shift channel at a predetermined time;

a plurality of shift driver circuits individually controlled in sequence for applying an operating voltage to each of the shift electrodes for shifting the discharge spot on a given shift electrode to an adjacent shift electrode simultaneously in each said shift channel;

circuit means having electrical conductors including a plurality of buses sequentially connecting the shift electrodes in a predetermined order to the buses, said circuit means connecting at least one of the shift electrodes to the write drive circuit at a predetermined time in the operation of the apparatus wherein an indication line consisting of a plurality of said discharge spots generated simultaneously on said given shift electrode is shifted to rotate;

a control circuit for providing an addition control pulse and a subtraction control pulse in response to a deviation between an information to be displayed and a position of said indication line; and a reversible counter having a plurality of stages each coupled to a corresponding one of the shift driver circuits whereby the output of each stage of the reversible counter drives the corresponding shift driver circuit, said reversible counter counting an addition control pulse and a subtraction control pulse from the control circuit for controlling the shift operation of said indication line.

3. Gas discharge display apparatus, comprising a gas discharge panel having a first substrate, a plurality of looped electrodes concentrically arranged on the first substrate, the looped electrodes being in a plurality of groups, a first dielectric layer coating the looped electrodes at a surface of the first substrate, a second substrate, a plurality of radially extending shift electrodes arranged regularly on the second substrate, a second dielectric layer coating the shift electrodes at a surface of the second substrate, said substrate being positioned face to face with a gap therebetween, said gap being filled with an ionizable gas;

a plurality of common terminals each connected to a corresponding one of the groups of looped electrodes;

a plurality of common drive circuits for providing operating voltages, each of said common drive circuits being connected at a corresponding one of the common terminals and each being individually controlled for applying a corresponding timing drive;

a plurality of buses each connecting the shift electrodes sequentially;

a write driver circuit for applying a write voltage, said write driver circuit being connected to at least one of the shift electrodes for generating a plurality of discharge spots on said one of said shift electrodes at a starting time;

a plurality of shift driver circuits for providing shift voltages sequentially for shift operation, said shift driver circuits being connected respectively to said buses for shifting the discharge spots from a given shift electrode to an adjacent shift electrode along each of said groups of said looped electrodes wherein a plurality of indication lines each displayed on the respective groups of said looped electrodes are shifted to rotate at a selected rate;

a pulse generating circuit for providing a standard pulse train; and a control circuit including first counter means for switching the timing of application of the shift voltage to the buses from the shift driver circuits, said first counter means comprising a multistage ring counter, and second counter means for controlling the timing of application of the operating voltages to at least one of the common terminals from at least one of the common drive circuits at predetermined counts of said second counter means, said first counter means counting the standard pulses from said pulse generating circuit and said second counter means counting said standard pulses in divided relation.

* * * * *